United States Patent [19]

Leighton

[11] 3,947,001

[45] Mar. 30, 1976

[54] COMBUSTION SYSTEM

[75] Inventor: Guy P. Leighton, Monroeville, Pa.

[73] Assignee: Dravo Corporation, Pittsburgh, Pa.

[22] Filed: Jan. 13, 1975

[21] Appl. No.: 540,567

[52] U.S. Cl. ..... 266/20; 266/21; 432/137

[51] Int. Cl.[2] ..... F27B 9/06

[58] Field of Search ..... 266/20, 21, 14; 75/35, 75/36, 5, 91; 432/137, 138, 144, 145, 241

[56] References Cited

UNITED STATES PATENTS

| | | | |
|---|---|---|---|
| 1,896,625 | 2/1933 | Hyde | 266/21 X |
| 2,750,272 | 6/1956 | Lellep | 266/21 X |
| 2,750,273 | 6/1956 | Lellep | 266/21 X |
| 2,750,274 | 6/1956 | Lellep | 266/21 X |
| 3,620,519 | 11/1971 | Forbes | 266/21 X |
| 3,756,768 | 9/1973 | Scott | 432/17 |
| 3,871,631 | 3/1975 | Biewinga | 266/21 |

*Primary Examiner*—Roy Lake
*Assistant Examiner*—Paul A. Bell
*Attorney, Agent, or Firm*—Parmelee, Miller, Welsh & Kratz

[57] ABSTRACT

This invention relates to the heat induration of formed bodies of ore such as green iron ore pellets on a travelling grate and more particularly to an improved, simplified combustion chamber construction.

9 Claims, 2 Drawing Figures

COMBUSTION SYSTEM

BACKGROUND OF THE INVENTION

It is well known in the art to pelletize beneficiated ore and subject the so-called green pellets to a heat-hardening process that enables them to withstand breakage during shipment and crushing in the stock column of a blast furnace. The most commonly employed method of heat-hardening is that of disposing the pellets on a pelletizing strand having a succession of pallets that carry the pellets under a hood or tunnel-like enclosure progressively through drying, preheating, firing, after-firing and cooling zones. A typical travelling grate apparatus for effecting heat-hardening of green pellets is disclosed, for example, in U.S. Pat. No. 3,172,754, Briggs, et al., assigned to the assignee of this application.

The initial step of drying is carried out at moderate temperatures to permit moisture in the pellets to escape gradually, for at high temperatures the moisture is converted to steam too rapidly, causing disruption of the pellets. After drying, the pellets are fired to a temperature sufficient to harden them but not at such a temperature to cause the pellets to fuse. Generally, temperatures in the range of 2300°F. to 2500°F. are employed, the heat being supplied from fuel burners located at spaced intervals along the walls of the firing hood. The burners are horizontally disposed above the pellet bed and preheated, recuperated air derived from the cooling zone is supplied to the individual burners from a central, longitudinally extending conduit through downcomer pipes, the heated combustion gases being drawn down through the pellet bed via windboxes disposed under the travelling grate.

When using highly radiant fuel, such as oil or powdered coal, it was found that the radiant heat from the luminous flame caused overheating of the pellets at the top of the bed where they were directly exposed to the flame, resulting in fusion of the top layer of pellets. To overcome this, a laterally extending refractory tunnel was built out from each burner port in the sidewall of the firing hood with the burner located at the outer end of the tunnel, the tunnel being of such length that most of the combustion space was provided within the tunnel, thus shielding the pellets from direct exposure to the radiant heat from the burners. This construction, however, is disadvantageous from the standpoints of initial cost and added maintenance expense since the refractory lining of the tunnels require regular replacement and repair due to the high destructive thermal conditions to which they are subjected.

Another proposed solution to this problem is provided in U.S. Pat. No. 3,620,519, Forbes, assigned to the assignee of this application, which provides a secondary enclosure or tunnel disposed within the main enclosure, the burners in one embodiment being located outside of and above the secondary tunnel which shields the pellets in the top of the bed from direct exposure to the radiant heat of the burner flame. This construction is also disadvantageous from cost and maintenance standpoints.

SUMMARY OF THE INVENTION

The invention provides an improved, simplified firing hood construction having vertical combustion chambers preferably disposed on each side of the firing zone of the travelling grate with a burner vertically disposed within each chamber. This construction significantly reduces initial cost and maintenance expense as compared with conventional constructions which require several burners and associated downcomers. The vertical positioning of the burner in the combustion chamber, as well as the increased volume available for combustion in the vertical chamber as opposed to the conventional horizontal arrangement reduces refractory wear and reduces slag erosion in the vicinity of the flame while at the same time shielding the pellet bed from direct radiation. The combustion chamber is so configured that all surfaces within the enclosure that might be in contact with slag are subjected to direct radiation from the burner flame in order to maintain the slag in a molten state.

DESCRIPTION OF THE DRAWINGS

A preferred embodiment of the invention is illustrated by the following drawings, wherein.

DETAILED DESCRIPTION OF THE INVENTION

Figure 1:
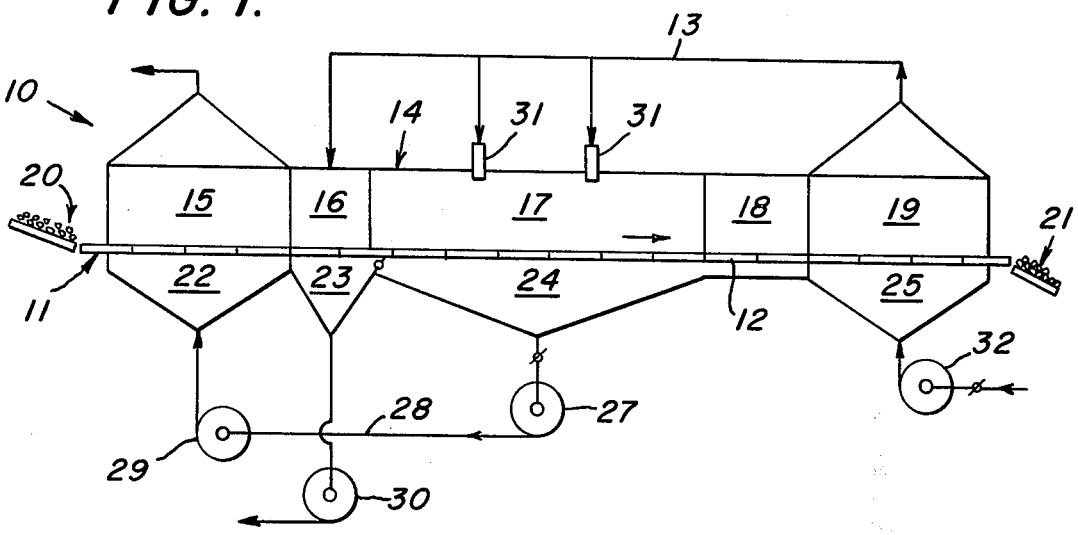
FIG. 1 is a simplified schematic longitudinal section of a travelling grate apparatus embodying the invention.

FIG. 1 is a schematic representation of a typical pelletizing apparatus 10. A travelling grate structure is indicated at 11, which is comprised of a plurality of abutting material holding pallets 12 which pallets travel along a horizontal trackway through the various treatment zones. Details of the construction of the pelletizing apparatus and the travelling grate structure are not shown as the same are well known to the art. A hood structure or tunnel-like enclosure 14 is disposed over the travelling grate and is transversely divided into a succession of treating zones, namely a drying zone 15, a preheating zone 16, a combustion or firing zone 17, an after-firing zone 18 and a cooling zone 19.

Previously formed green iron ore pellets or compacted ore bodies are charged at 20 onto the pallets to a uniform depth and are passed successively through the said treating zones and the treated pellets are discharged at 21. The pallets pass over a succession of windboxes 22 to 25 arranged respectively below each of said treating zones, the windboxes controlling the circulation of gases vertically through the pellet bed. For practical reasons, each of windboxes 22 to 25 is composed of a plurality of smaller windboxes rather than the single extended windboxes as depicted.

The pallets 12, after being charged with pellets, pass through an updraft drying zone 15 wherein heated gases, from combustion zone 17 via windbox 24, blower 27, conduit 28 and blower 29, are passed upwardly through the pellets to remove the free moisture therefrom. Usually drying of the pellets is effected in two stages, i.e., updraft drying followed by downdraft drying as described, for example, in the aforementioned U.S. Pat. No. 3,172,754. Alternatively, two-stage downdraft drying may be employed as described in pending U.S. pat. application Ser. No. 403,919, Boss, filed Oct. 5, 1973, and assigned to the assignee of this application.

After being dried and partially heated, the pellets are conveyed into a preheating zone 16, heated air being conveyed via duct 13 from cooling zone 19. The heated air is passed downwardly through the pellets via windbox 23 and blower 30. In the preheating zone 16, the dried pellets are exposed for a short time to a flow of high temperature gases to lessen thermal shock upon entering the high temperature combustion zone. Cooling air is supplied to cooling zone 19 via blower 32 and windbox 25.

The pellets are then conveyed through combustion or firing zone 17 wherein the pellets will reach a temperature of between about 2300°F. to 2500°F. A high temperature, generally oxidizing atmosphere is maintained in the firing zone by a combination of heated gases derived via duct 13 from cooling zone 19 and fuel burners 31, the heat generated by the fuel burners supplying the additional heat to heat the hot gas from the cooling zone to the pellet firing temperature. After firing, the pellets are conveyed through the after-firing zone 18, the cooling zone 19 and discharged from the apparatus at 21.

The foregoing description is exemplary of a typical pelletizing apparatus and process and is intended to place the invention in its proper perspective and is in nowise intended as a limitation on the scope of the invention except as hereinafter provided. As previously stated, the invention is concerned with a particular combustion chamber construction which will be described in detail with reference to FIG. 2.

Figure 2:
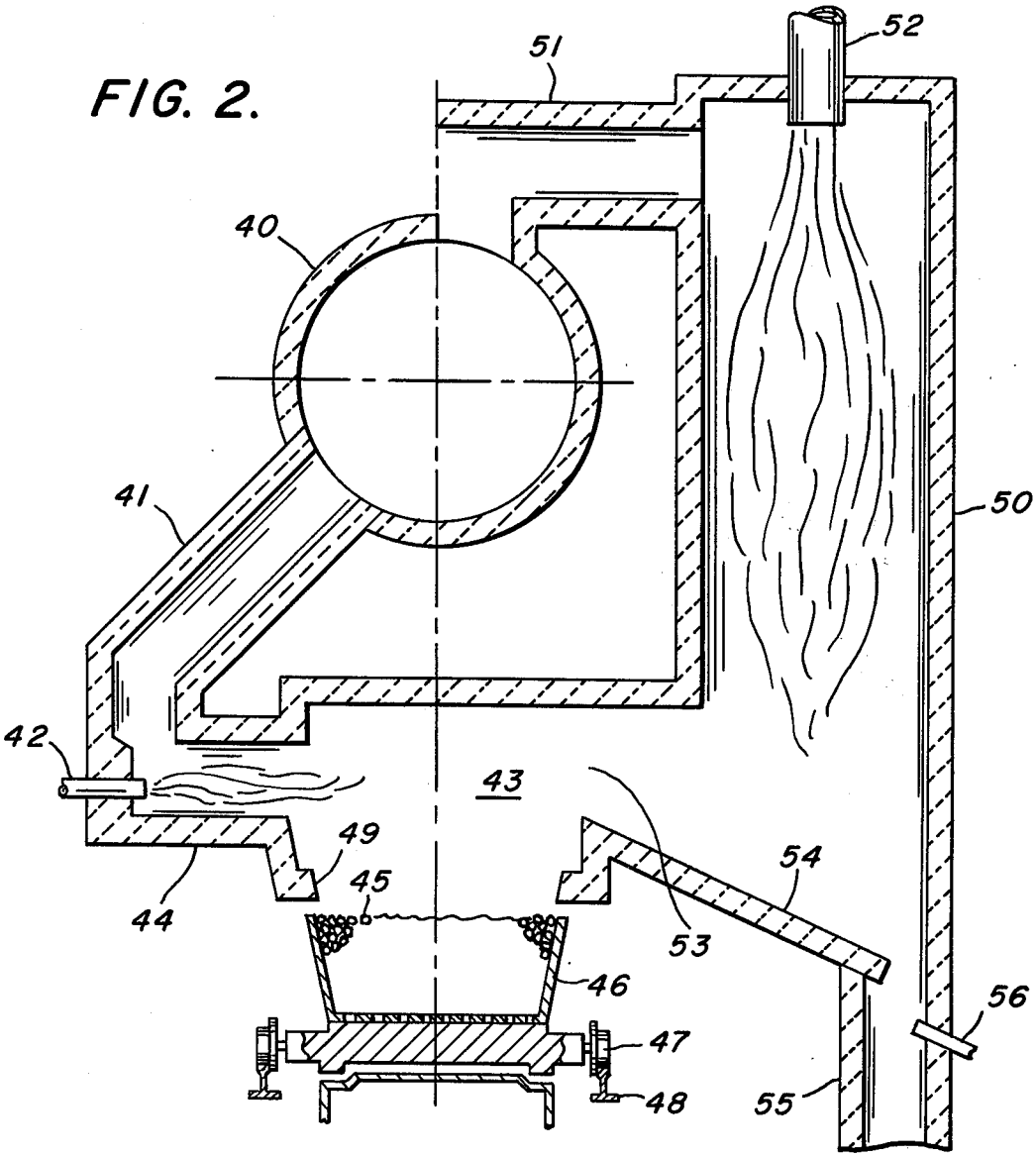
FIG. 2 is a transverse vertical section of a firing chamber showing the combustion chamber construction of the invention on the right and a conventional downcomer construction on the left.

In FIG. 2, a conventional sidewall burner arrangement is depicted on the left and the burner arrangement according to the invention is depicted on the right. In the conventional arrangement, hot recuperated combustion air is conveyed from the cooling zone of the pelletizing strand via conduit 40 (duct 13 of FIG. 1) and downcomer pipe 41, the air being heated by fuel burner 42 and the heated air being directed horizontally into firing chamber 43 (firing zone 17 of FIG. 1) via laterally extending tunnel 44. As beforementioned, the green pellets 45 are disposed on pallets 46, the pallets 46 being provided with wheels 47 which engage horizontally disposed tracks 48. In addition, sliding seals (not shown) are provided in known manner between the pellets and the hood structure 49 and between the pallets and the tops of the windboxes. Such seals are described, for example, in U.S. Pat. No. 3,172,936. In a typical pelletizing strand, a plurality of downcomers 41, burners 42 and laterally extending tunnels 44 are employed at spaced intervals along the length of the firing chamber 43. Although the conventional system of downcomers and firing ports is satisfactory when natural gas or oil is used as burner fuel, this arrangement is unsatisfactory if pulverized coal is used as fuel. For example, fuel distribution problems result from feeding pulverized coal to a multiplicity of burners and the flame length using coal would be excessive for the short horizontal firing ports as a result of low energy mixing with the recuperated air. As before stated, combustion flames directly impinging on the pellet bed are detrimental as high radiation from the flame causes the pellets in the upper portion of the pellet bed to revert to magnetite which is undesirable from a pellet quality standpoint due to the high ferrous iron content and, moreover, fusion of the pellets often results.

According to the invention, the said groups of conventional downcomers and horizontal firing ports are replaced by a vertically extending combustion chamber 50, one of said chambers replacing several conventional downcomers and associated horizontal firing ports. Depending on the size and capacity of the pelletizing apparatus, one combustion chamber according to the invention could replace at least five and as many as eight or ten conventional burner arrangements. In the construction according to the invention, hot recuperated combustion air from conduit 40 is tangentially directed into the top of chamber 50 via duct 51. The air is heated to process temperature by the direct combustion of pulverized coal injected via a burner gun 52 which extends downwardly through the roof of chamber 50. The chamber 50 is preferably of a cylindrical configuration with the burner gun 52 coaxial therewith. The chamber 50 is sized so that virtually all of the combustion takes place within the chamber, the heated gases exiting the chamber proximate the lower end and directed into firing chamber 43 via outlet 53. As the pulverized coal upon firing will produce ash which has a fluid temperature in the range at or below the pelletizing temperature, i.e., about 2450°F., the chamber 50 is further provided with means to remove molten slag which unavoidably becomes entrapped in the chamber. The bottom 54 of chamber 50 is sloped downwardly toward a peripherally located tap line 55 communicating with a water seal and slag quench tank (not shown). If desired, an auxiliary burner 56, preferably an oil or gas fired burner may be located on tap line 55 to maintain the slag in a molten state to prevent plugging and fouling. The combustion chamber 50 is, of course, lined with suitable refractory material in known manner.

The combustion chamber 50 and burner gun 52 are designed to optimize the use of hot recuperated combustion air in order to maximize process efficiency. The burner gun is sized so as to give a high coal jet velocity relative to the increasing recuperated air velocity to assure adequate mixing. However, the coal jet velocity must be low enough to keep the ignition distance short. The combustion of the coal jet mixing with recuperated air due to the differential velocity and the heating of the coal particles by the high temperature recuperated air will provide a stable flame pattern of reasonable flame length.

Preferably, the flame pattern should be narrow at the top of the chamber to prevent impingement of molten slag on the relatively cool upper walls but should be approximately the height of the chamber to keep the slag on the bottom of the chamber as hot as possible to maintain free slag flow.

A pilot test combustion chamber designed to heat 4000 SCFM of recuperated air from 1500°F. to 2450°F. was installed beside an operating pelletizing machine. This was done so that the test chamber would be supplied with recuperated air under actual commercial plant conditions of temperature, composition, and particulate loading. Recuperated air from the cooling zone was used to feed the test chamber which was 3 feet, 6, inches I.D. × 22 feet, 0 inches inside refractories. The test chamber was lined with 9 inches of Harbison Walker "Coralite" Plastic (80/85% $Al_2O_3$) backed up with 4½ inch of insulating firebrick. The bottom was sloped toward a central 9 inch dia. refractory lined tap hole which was connected by a 24 inch dia. pipe to a water seal and slag quench tank below. Heated gases were exhausted through a water spray quench chamber by way of a connecting duct between the firing and quench chambers. Temperatures and pressure of the chamber were continuously monitored from top to bottom of the chamber as well as other appropriate points. Recuperated air flow to the chamber was measured by means of high temperature pitot tube type devices.

Since coal pulverization is a proven technology, the coals used in the test chamber were pulverized elsewhere, bagged and shipped to the test site.

Temperature control was achieved by feeding coal into the transport air stream to the burner gun by means of a hopper and variable speed screw feeder in known manner.

A coal fired pelletizing plant is usually started up on fuel oil or gas before switching to pulverized coal. Oil or gas may also be used as alternate fuels with the ability to switch fuels as desired. The test chamber was, therefore, first fired with No. 6 fuel oil using less than 20% of stoichiometric air passing through the burner as atomizing and combustion air. Oil firing in the chamber with the large volume available for combustion did not present any problems. Compared to the conventional burner ports, refractory life and maintenance is considerably improved because of the much smaller heat release per cubic foot of chamber volume.

Test firing was then started using a shipment of subbituminous "B" coal from the Big Sky Mine in Montana. Following are typical properties:

BIG SKY I COAL
Actual Proximate Analysis as Received

| | |
|---|---|
| Moisture | 19.01% |
| Ash | 11.11 |
| Volatiles | 32.18 |
| Fixed Carbon | 37.70 |
| S | 1.19 |
| BTU/lb | 8855 |
| Structure | +90% - 200 Mesh |
| Fusions (Oxidizing) | |
| Initial Deformation | 2290°F. |
| H = W | 2345° |
| H = ½ W | 2405° |
| Fluid | 2455° |

With the test chamber preheated to approximately 1200°F. by hot recuperated air, the pulverized coal jet ignited spontaneously. Flame shape and length were as predicted. Neither the burner gun nor wall refractories were modified, cleaned or replaced throughout the remainder of the test program. The upper portion of the chamber stayed clean and free of slag buildup. Below this, slag on the chamber sidewalls melted and ran to the bottom. Slag flowed freely on the bottom to the tap hole.

After less than 2 days of operation, however, the chamber had to be shut down because the slag tap hole became plugged with frozen slag droplets. The slag froze due to radiation losses to the black body formed by the water seal and quench tank below the tap hole.

Various modifications were subsequently made to this central tap hole and bottom. The length of the tap hole was shortened. To cause the slag to run in rivulets and encourage mass flow, runner bricks were installed. Tests, with and without a standing slag pool using one or more runner bricks were performed. An offtake duct was also attached to the drop pipe between the tap hole and water seal to pull hot gases from the chamber down through the tap hole to offset heat loss to the slag quench tank. During a later test run with a standing pool of slag in the bottom, unmelted material developed on the bottom. The deposits were analyzed and were found to be caused by the slag picking up alumina from the Coralite refractory. On subsequent test runs, these deposits did not appear. The walls of the chamber, although penetrated by slag to a depth of 2 to 3 inches, had stabilized to the point where alumina pick up stopped. All tests run with this central tap hole bottom configuration were eventually terminated by slag tap hole plugging.

The entire bottom of the chamber was then replaced by one having a steeper, i.e., about 30°, slope to a tap hole at the side of the chamber, as shown in FIG. 2. A gas burner was placed in the side of the tap hole and tilted upward to insure that temperature in the vicinity of the hole could be maintained. At this time, Harbison-Walker "Korundal" Plastic (85% $Al_2O_3$ Phosphate Bonded) was used instead of "Coralite" for the new bottom. With the modified bottom configuration, the tap hole may be kept open indefinitely, thus solving the problem of geometric configuration for the bottom and tap zone.

However, after running with this bottom for a week, shutdown was required because molten slag washed out much of the Korundal Plastic in the vicinity of the slag runner, also destroying the 60% $Al_2O_3$ cast tap hole burner block. The bond between the high alumina grains of the plastic were washing out and the grains were carried out by the molten slag. Based on laboratory refractory tests and sample performance in the test chamber, this bottom was then relined with 4 ½ inch of Harbison-Walker 69-65 "Ruby" Brick (90% $Al_2O_3$ with an $Al_2O_3$ — $Cr_2O_3$ solid solution bond). The Ruby Brick lining was backed up by 4 ½ inch of Harbison-Walker "Coralite" Plastic and 4 ½ inch of insulating firebricks.

A 20 day run was made with the new bottom. The tap hole was easily kept open and the bottom and connecting duct to the quench chamber operated free of buildup. The bottom lining at the end of the run was found to be in excellent condition.

During the long-term stable conditions obtained during this test run, gas analysis and unburned carbon profiles were taken in the test chamber. These data showed that combustion was virtually completed within the chamber. The exit gases showed high combustion efficiency and only negligible amounts of unburned carbon were found in the particulates.

Although the invention has been described by the foregoing in considerable detail with reference to a preferred embodiment, many variations therein may be made by those skilled in the art without departing from the spirit and scope thereof. For example, the dimensions, the number of vertical combustion chambers and the placement thereof will vary depending on the size and capacity of a given pelletizing apparatus. In addition, although the invention has been illustrated with reference to a straight-line type of pelletizing apparatus, it is equally applicable to a pelletizing apparatus having a circular configuration.

What is claimed is:

1. In a pelletizing apparatus of the travelling grate type for heat indurating compacted ore bodies, comprising a drying zone, a firing zone and a cooling zone, an improved combustion means comprising:

at least one vertically extending chamber located adjacent the firing zone and to one side of the travelling grate, said chamber communicating proximate its lower end with the firing zone, fuel injection means vertically oriented in the upper end of said chamber and means for introducing recuperated air from the cooling zone into the upper end of said chamber.

2. The improvement of claim 1 wherein said chamber is of a cylindrical configuration.

3. The improvement of claim 1 wherein said means for introducing recuperated air into the chamber comprises a conduit, communicating between the chamber and a recuperated air return duct extending from the cooling zone to the firing zone.

4. The improvement of claim 1 wherein said fuel injection means is a burner gun vertically extending through the roof of the chamber.

5. The improvement of claim 4 further including means for feeding pulverized coal through said burner gun.

6. The improvement of claim 5 wherein said chamber further includes molten slag removal means.

7. The improvement of claim 6 wherein the bottom of said chamber is sloped downwardly toward a peripherally located slag tap.

8. The improvement of claim 7 wherein the bottom of said chamber is sloped about 30°.

9. The improvement of claim 7 wherein auxiliary fuel burner means are located in said slag tap.

* * * * *